US008159407B2

(12) United States Patent
Dittrich et al.

(10) Patent No.: US 8,159,407 B2
(45) Date of Patent: Apr. 17, 2012

(54) RADOME WITH INTEGRATED PLASMA SHUTTER

(75) Inventors: Kay Dittrich, Hoehenkirchen (DE); Joachim Kaiser, Bremen (DE); Robert Sekora, Ingolstadt (DE); Herbert Zippold, Bruckmuehl (DE)

(73) Assignee: EADS Deutschland GmbH, Ottobrunn (DE)

( * ) Notice: Subject to any disclaimer, the term of this patent is extended or adjusted under 35 U.S.C. 154(b) by 497 days.

(21) Appl. No.: 12/257,555

(22) Filed: Oct. 24, 2008

(65) Prior Publication Data

US 2009/0109115 A1 Apr. 30, 2009

(30) Foreign Application Priority Data

Oct. 26, 2007 (DE) ..... 10 2007 051 243

(51) Int. Cl.
*H01Q 1/52* (2006.01)

(52) U.S. Cl. ..... 343/841; 343/872

(58) Field of Classification Search ..... 343/872, 343/841, 701, 700 MS, 702, 703
See application file for complete search history.

(56) References Cited

U.S. PATENT DOCUMENTS

| | | | | |
|---|---|---|---|---|
| 4,684,954 | A * | 8/1987 | Sureau et al. | 343/909 |
| 5,028,474 | A | 7/1991 | Czaplicki | |
| 5,182,496 | A | 1/1993 | Manheimer et al. | |
| 5,328,779 | A * | 7/1994 | Tannenberger et al. | 429/463 |
| 5,574,471 | A * | 11/1996 | Sureau | 343/909 |
| 5,621,423 | A * | 4/1997 | Sureau | 343/909 |
| 6,183,836 | B1 * | 2/2001 | Pflug | 428/116 |
| 6,218,978 | B1 | 4/2001 | Simpkin et al. | |
| 6,767,606 | B2 * | 7/2004 | Jackson et al. | 428/118 |
| 7,342,549 | B2 * | 3/2008 | Anderson | 343/770 |
| 7,453,403 | B2 * | 11/2008 | Anderson | 343/701 |
| 7,755,254 | B2 * | 7/2010 | Kobayashi et al. | 310/328 |

FOREIGN PATENT DOCUMENTS

| | | |
|---|---|---|
| DE | 39 20 110 A1 | 2/1991 |
| DE | 41 40 944 A1 | 6/1993 |
| DE | 43 36 841 C1 | 5/1995 |

* cited by examiner

*Primary Examiner* — Jacob Y Choi
*Assistant Examiner* — Kyana R McCain
(74) *Attorney, Agent, or Firm* — Greenblum & Bernstein, P.L.C.

(57) ABSTRACT

Radome with an integrated plasma shutter covering an antenna and method for selectively shielding an antenna. The radome includes a honeycomb core formed to contain a plasma-guiding layer, and coverplates arranged to sandwich the honeycomb core. Electrodes are structured and arranged for plasma excitation, the electrodes being high frequency (HF)—transparent at least in an operating frequency range of the antenna. The instant abstract is neither intended to define the invention disclosed in this specification nor intended to limit the scope of the invention in any way.

19 Claims, 6 Drawing Sheets

RADOME WITH INTEGRATED PLASMA SHUTTER

CROSS-REFERENCE TO RELATED APPLICATIONS

The present application claims priority under 35 U.S.C. §119 of German Patent Application No. 10 2007 051 243.2 filed Oct. 26, 2007, the disclosure of which is expressly incorporated by reference herein in its entirety.

BACKGROUND OF THE INVENTION

1. Field of the Invention

The invention relates to a radome with an integrated plasma shutter that includes a plasma-guiding layer and electrodes for plasma excitation.

2. Discussion of Background Information

Antennas (e.g., of radar sets or of other sensors or communication devices) on aircraft, but also on ships or ground stations are often sealed off from the environment by electromagnetically transparent covers, so-called radomes. Problems exist with radomes of military aircraft in that the electromagnetic transparency of the radome necessary for the operation of the antenna system lying beneath it makes it more or less permeable for other undesirable electromagnetic waves. Consequently the following results:

The radar signature of a radome with antenna lying beneath it is generally much higher due to the reflections from the radome interior than the radar signature that would result from the exterior geometry of the radome with conductive or radar-absorbing embodiment.

The antenna and the surrounding installations are acted on unimpeded by interfering radiation penetrating into the radome. This interfering radiation can either be directed to the antenna and the surrounding installations in a targeted manner (e.g., by an interfering transmitter) or originate from any sources (e.g., from other radar equipment or other radiation sources).

This problem has been alleviated or prevented completely by a radome embodied or formed to be electromagnetically transparent only in the desired frequency range and/or only at the times at which the antenna is active.

In order to achieve this, various methods are already known:

So-called frequency-selective radomes exhibit a dependency of the electromagnetic transparency as a function of the frequency, so that its own working frequency range is allowed through the radome in a more or less unimpeded manner, but other frequency ranges are blocked or substantially damped. Depending on the design and requirement, the frequency filter formed by the frequency-selective radome can be a band-pass filter, a high-pass filter, or a low-pass filter.

Switchable radomes can be switched backwards and forwards between an electromagnetically transparent state and an electromagnetically reflecting or absorbing state.

Frequency-selective radomes can be realized with different methods, depending on the requirement profile. In particular, the use of one or more thin structured metal layers, so-called frequency-selective layers (FSL), which have a pronounced frequency dependence of the electromagnetic transparency, is known, e.g., from U.S. Pat. No. 6,218,978.

Switchable radomes can be realized in different ways. Mechanical shutter systems are thus known, in which shades are slid in front of the antenna. Another approach lies in inserting layers with variable surface impedance into the radome, such as through the use of pin diodes or of photoresistances according to German Application No. DE 39 20 110 C2. The variable layer can thereby act in an electrically conductive and thus reflecting or electrically insulating and thus transparent manner depending on the switching status.

Another approach for realizing a variable layer is the use of a layer or a volume of plasma. A plasma layer is electrically conductive, and a sufficiently high electrical conductivity for the reflection or damping of electromagnetic waves can be achieved depending on the charge density in the plasma. This behavior is already used for plasma-based antennas; see, e.g., U.S. Pat. No. 5,182,496. The desired switching action can be achieved by switching the plasma on and off.

With a plasma shutter, there is in principle the question of the integration of the plasma volume into the radome structure. A plasma shutter system has become known from the Russian Academy of Sciences, in which the area between the antenna and radome is filled with a plasma. Another concept according to German Application No. DE 43 36 841 C1 is based on plasma-filled tubes in front of the antenna. The plasma in the tubes is generated by lateral electrodes not lying in the visual range of the antenna. The disadvantage of the latter concept is the fact that the shutter element represents a separate component with respect to the radome, so that the stability of the radome is reduced by the installation of the shutter element. The integration of the shutter element into the radome furthermore leads to additional radar scattering centers on the radome, which has an unfavorable effect on the radar signature. Furthermore, the two electrodes for plasma generation are arranged laterally on the narrow sides of the plasma-guiding layer, which reduces the homogeneity of the electromagnetic field within the plasma-guiding layer.

SUMMARY OF THE INVENTION

Embodiments of the invention are directed to a radome with integrated plasma shutter is provided for protecting an antenna against undesirable incidence radiation, while the structural strength and the radar signature of the radome are not negatively influenced.

According to embodiments of the invention, the radome has a sandwich structure of a honeycomb core and cover plates. The plasma-guiding layer is contained in the honeycomb core of the sandwich structure and the electrodes are HF-transparent at least in the operating frequency range of the antenna.

Thus, the present invention is based on a concept of integrating the plasma-guiding layer into the honeycomb core of the radome structure, which is embodied or formed as a sandwich, and of carrying out the generation of the plasma by electrodes that are HF-transparent at least in the operating frequency range of the antenna.

The cover plates of the sandwich structure delimiting the plasma layer thus themselves form a part of the load-carrying radome primary structure, and the honeycomb structure that contains the plasma-guiding layer forms a structural bond with the cover plates.

This approach has a number of advantages compared to the methods heretofore known:

Through the integration of the plasma volume into the core of a radome structure, the outer interface of the plasma volume has virtually the same geometry as the radome shell, and can thus be geometrically camouflaged in its radar signature on the basis of the established rules of shaping.

Since the plasma shutter is itself part of the load-carrying primary structure of the radome, the plasma shutter does not cause any weakening of the radome structure.

The plasma shutter can be integrated into the radome without generating additional scattering centers.

Due to the transparency of the electrodes, they can be arranged in the visual range of the antenna. Thus, the homogeneity of the electromagnetic field inside the plasma-guiding layer is improved, so that a reliable and precise control of the plasma state is possible.

An HF-transparent electrode is embodied or formed, in particular, in a lamellar manner and can be realized, e.g., in the form of a latticed layer. The lattice constant is selected so that HF-transparency is ensured at least in the operating frequency range of the antenna (for a radar antenna, e.g., in the range of 8 to 12 GHz). In addition to a pure lattice arrangement, more complex periodic structures are also possible, such as, e.g., circular or annular slots in a continuous metal layer. Another possibility lies in using an electrically low conductive layer, the reflection factor of which is included in the radome design.

In a particularly advantageous embodiment, the electrodes are realized as frequency-selective layers. In particular, slot-like types of frequency-selective layers can be used, in which a continuous metal layer has structured slots. These slots can be designed as band-pass filters, so that the antenna system's own operating frequencies are allowed through the radome, while other frequencies are reflected or also absorbed.

The use of frequency-selective layers has in particular the following advantages:

The combination of frequency-selective layers and a plasma shutter makes it possible to combine the band-pass characteristics of an FSL with the switching behavior of the plasma volume and thus to further improve the protection with respect to undesirable radiation. Since the electrodes for plasma generation can be used at the same time as FSLs of the band-pass radome, they do not interfere with the band-pass function of the radome, but affect it themselves.

The electrodes of frequency-selective layers can be arranged in the visual range of the antenna without restrictions to the operation of the antenna.

Embodiments of the invention are directed to a radome with an integrated plasma shutter covering an antenna. The radome includes a honeycomb core formed to contain a plasma-guiding layer, and coverplates arranged to sandwich the honeycomb core. Electrodes are structured and arranged for plasma excitation, the electrodes being high frequency (HF)—transparent at least in an operating frequency range of the antenna.

According to embodiments of the invention, the electrodes may include frequency-selective layers formed as band-pass filters in the operating frequency range of the antenna.

In accordance with embodiments of the invention, the electrodes can be arranged on the cover plates.

Further, the electrodes can be arranged on walls of the honeycomb core.

According to still further embodiments of the present invention, the honeycomb core may include a folded honeycomb.

Moreover, the walls of the honeycomb core can have perforations.

According to other embodiments of the instant invention, the plasma-guiding layer can be switchable between a plasma state and a recombined state. Further, in the plasma state, the plasma-guiding layer is conductive, and in the recombined state, the plasma-guiding layer is electromagnetically transparent.

Moreover, the electrodes may include continuous metal layers with structured slots. The slots can be formed as band-pass filters.

Embodiments of the invention are directed to a method for selectively shielding an antenna. The method includes selectively switching a plasma-guiding layer located one of in or on a radome covering the antenna between a conductive plasma state and a non-conductive recombined state. When the antenna is active, the plasma-guiding layer is switched into the recombined state.

In accordance with features of the invention, the method can also include generating a plasma with lamellar frequency-selective electrodes. The plasma-guiding layer can be sandwiched between the electrodes.

Further, the plasma-guiding layer can include a honeycomb core. The honeycomb core may include a folded honeycomb with perforated walls.

Embodiments of the invention are directed to a radome covering an antenna. The radome includes a plasma shutter that may include a plasma-guiding layer and electrodes for exciting a plasma, and coverplates arranged to sandwich the plasma-guiding layer. The electrodes are selectively operable to open the plasma shutter so as to be transparent to electromagnetic radiation at least in an operating frequency range of the antenna.

According to embodiments of the invention, the electrodes can include frequency-selective layers formed as band-pass filters in the operating frequency range of the antenna.

According to further features, the electrodes may be arranged on opposite sides of the plasma-guiding layer.

In accordance with still yet further embodiments of the present invention, the plasma-guiding layer can include a honeycomb core. The electrodes may be arranged on walls of the honeycomb core.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF EMBODIMENTS OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
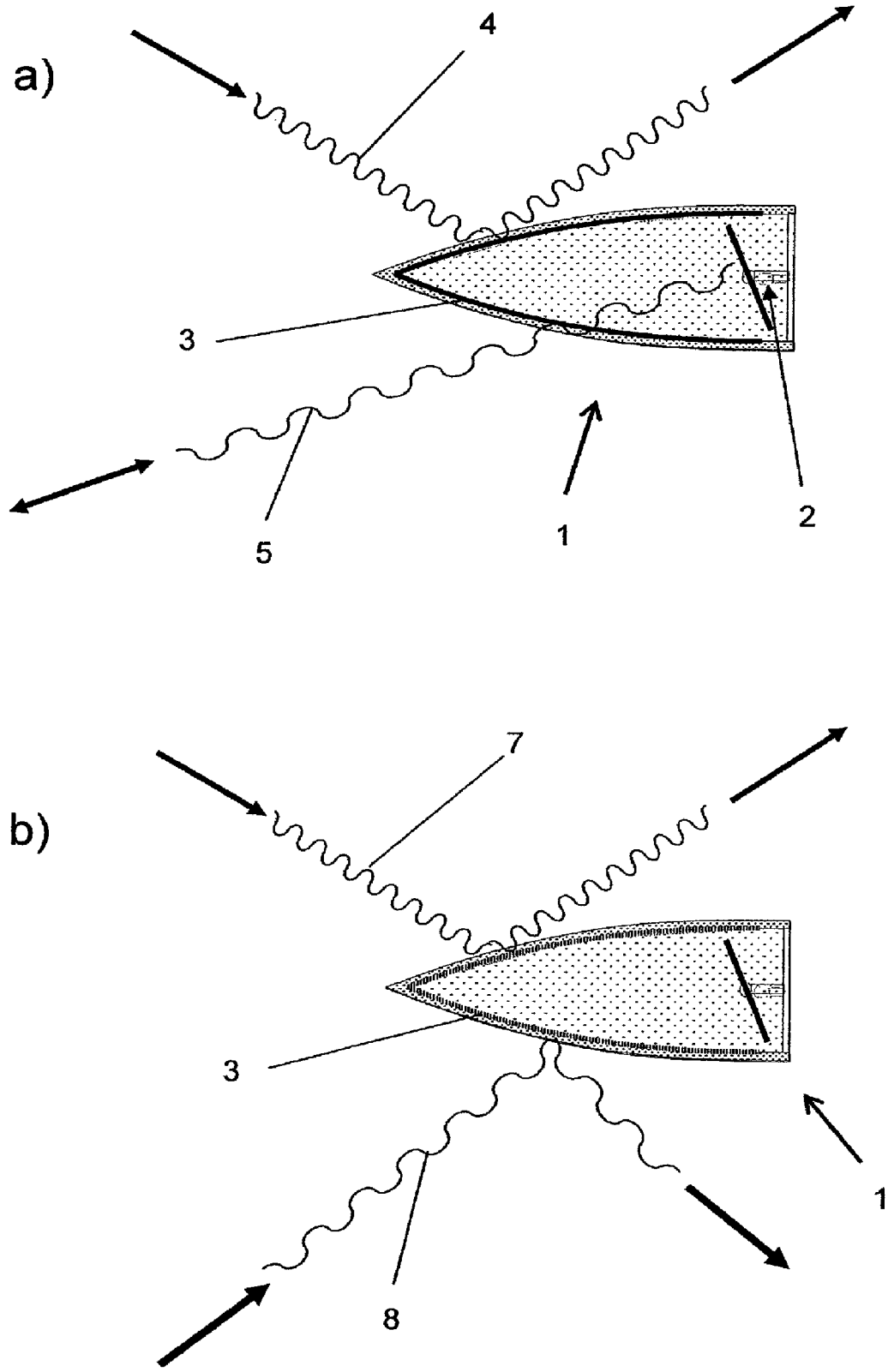
FIG. 1*a* illustrates a radome according to an embodiment of the invention in a recombined state of the plasma.
FIG. 1*b* illustrates the radome according to an embodiment of the invention in a plasma state.

FIGS. 1*a* and 1*b* illustrate a radome 1 according to an embodiment of the invention is arranged to cover an antenna system 2 lying beneath it. A plasma shutter can be integrated with radome 1, such that a plasma-guiding layer 3 can be located directly in or on radome 1. The plasma is excited via electrodes (not shown in FIG. 1) of frequency-selective layers.

FIGS. 1*a* and 1*b* show the effective mechanism in principle. Antenna system 2 in this case is represented as a rotatable radar antenna, without restriction of generality. However, it is understood that any other electromagnetically active antenna system, such as a communication antenna, a radar warning receiver, or an interfering transmitter can be attached under radome 1. The geometry of radome 1 is usually oriented to geometric requirements for radar signature reduction of the outer form.

The basic principle known per se regarding the use of plasma layer 3 as a variable reflector is based on the fact that plasma-guiding layer 3 can be switched backwards and forwards between a plasma state (FIG. 1*b*) and a recombined state (FIG. 1*a*). In the plasma state of FIG. 1*b*, which is generated by application of the voltage to the electrodes, plasma-guiding layer 3 is electrically conductive and reflects all incident electromagnetic waves 7 and 8. In the recombined state of FIG. 1*a*, plasma-guiding layer 3 is electrically non-conductive and thus electromagnetically transparent. Consequently, the wave 5 passes through radome 1.

In use, the plasma state in principle is adjusted. Only at times in which antenna 2 is active is it switched over to the recombined plasma state of FIG. 1*a*.

The plasma is generated by lamellar frequency-selective electrodes arranged on radome 1, which are permeable for electromagnetic radiation only within a certain frequency range, i.e., the operating frequency range of antenna 2. Thus, a protection against the incidence of undesirable radiation results in the recombined state of the plasma. This is indicated with radiation 4 in FIG. 1*a*, which is reflected by a frequency-selective layer.

Figure 2:
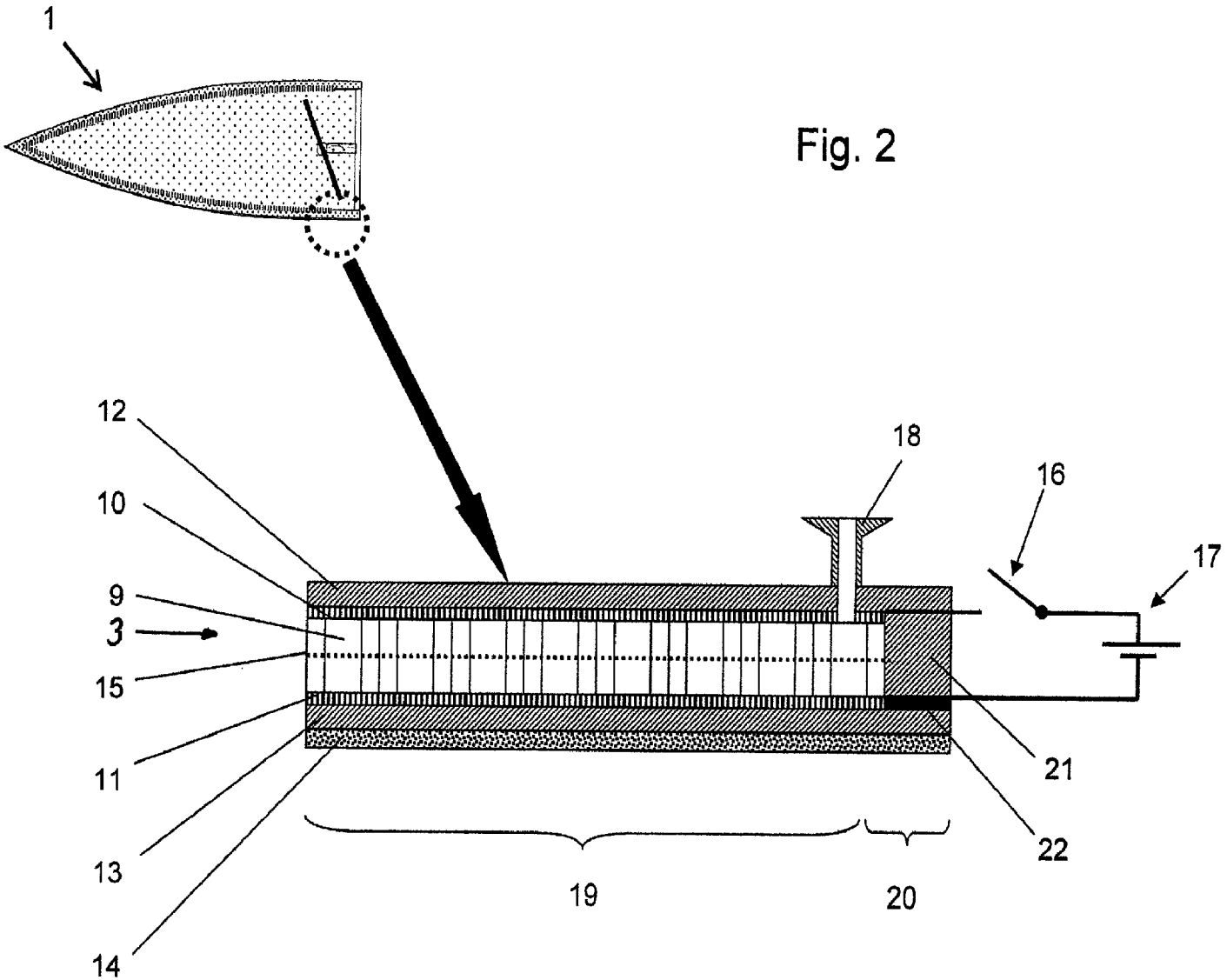
FIG. 2 illustrates a structure of a radome according to an embodiment of the invention with an integrated plasma shutter.

FIG. 2 shows the structure of radome 1 in greater detail. According to this exemplary embodiment, plasma-guiding layer 3 can comprise a honeycomb core 9 (here with cells having hexagonal cross sections) that is embedded or arranged between two lamellar electrodes 10 and 11. Plasma-guiding layer 3 with adjacent electrodes 10 and 11 is in turn attached or positioned between cover layers 12 and 13 of the structure of radome 1. In contrast to known solution approaches, plasma-guiding layer 3, i.e., the honeycomb core 9, forms a structural bond with cover layers 12 and 13.

In general, the cells formed within the honeycombs have a hexagonal cross section (e.g., in the form of an equilateral hexagon). However, other cell forms, e.g., with triangular or quadrilateral cell cross sections are also possible.

Optionally, a peripheral frame 21 is attached to an edge of radome 1 and frame 21 serves to connect radome 1 to the surrounding structure. Radome 1 can be divided into an electromagnetically transparent part 19 and an electromagnetically non-transparent part 20. Moreover, in a further embodiment electromagnetically non-transparent part 20 can be electromagnetically closed by a continuous electrically conductive layer 22. On the outside, optionally additional protective layers 14 can also be attached against rain erosion. Additional frequency-selective layers are also conceivable in radome cover layers 12 and 13 or on the surface of radome 1 in order to adjust the band-pass behavior even more precisely.

Electrodes 10 and 11 in the illustrated embodiment are embodied or formed in a lamellar manner and comprise frequency-selective layers. By way of example, slot-like types of frequency-selective layers, e.g., in which a continuous metal layer has structured slots, are particularly suitable as electrodes. In the embodiment shown, electrodes 10 and 11, respectively, have a regular pattern formed from cruciform slots. Slots of this type can be designed as band-pass filters, such that the operating frequencies of antenna system 2 are allowed through radome 1, but other frequencies are reflected or absorbed. Electrodes 10 and 11 can easily be arranged in the visual range of antenna 2 due to their HF-transparency in the range of the operating frequencies of antenna 2.

In order that a gas mixture suitable for the generation of a plasma can be introduced into plasma-guiding layer 3 at a suitable vacuum, honeycomb 9 has perforations 15 and thus is air-permeable in its plane, so that, through one or more connections 18, a rinsing of plasma-guiding layer 3 with a suitable gas mixture and a suctioning off until the necessary vacuum has been achieved for generating the plasma is possible. After adjustment of the desired gas mixture and pressure level, the connection or connections are closed, this process can be repeated for maintenance purposes at suitable intervals.

If necessary, honeycomb 9 can also be coated with a protective layer in order to avoid a wear of the honeycomb material by the aggressive plasma.

The two frequency-selective layers 10 and 11 serving as electrodes are connected via a switching device 16 to a high-voltage source 17 so that, upon application of the high voltage, the plasma can ignite in plasma-guiding layer 3.

Figure 3:
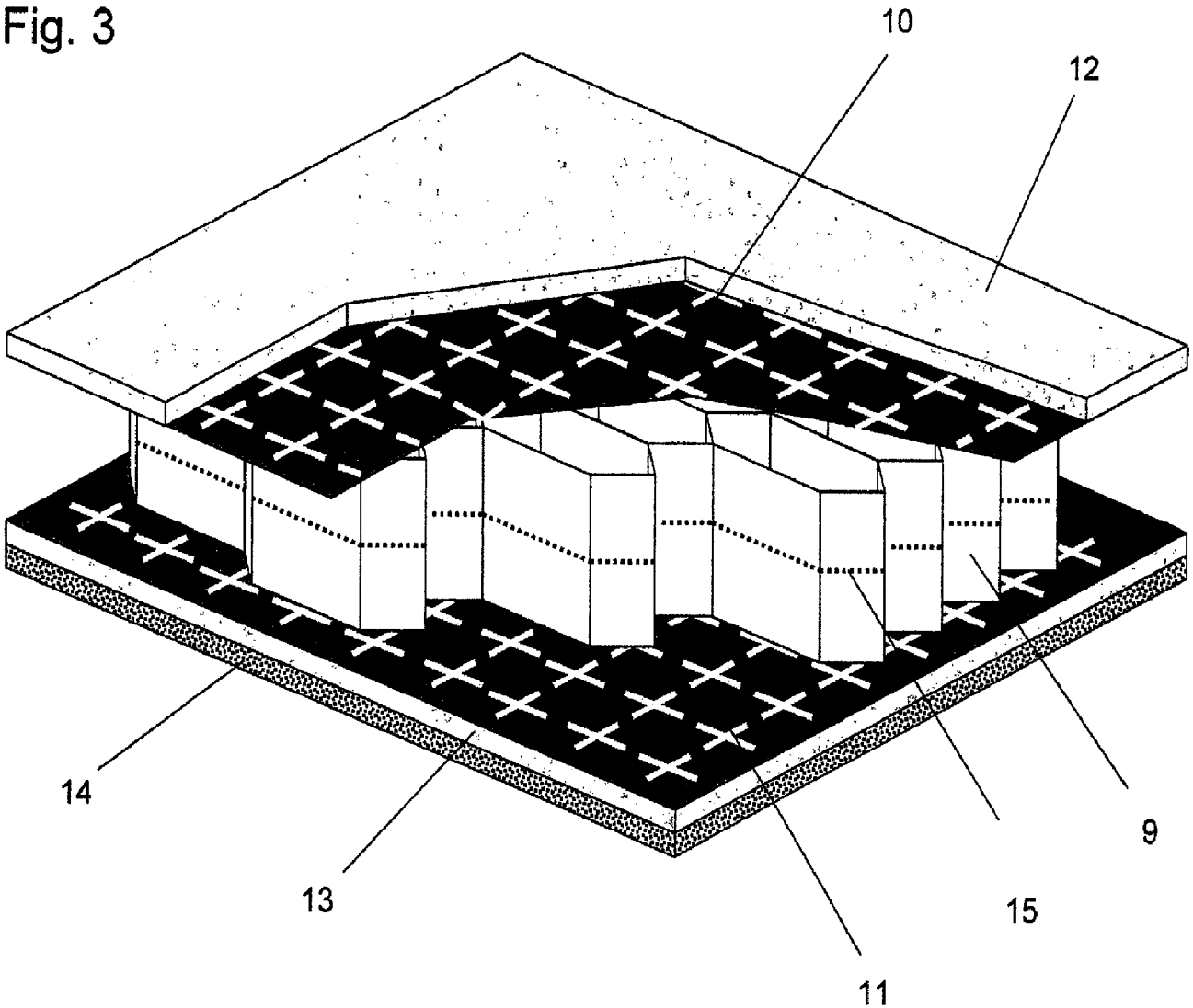
FIG. 3 illustrates a three-dimensional representation of the radome depicted in FIG. 2.

FIG. 3 shows the diagrammatic structure according to FIG. 2 in a three-dimensional representation.

Another variant results in that a so-called folded honeycomb 5, as described in U.S. Pat. No. 5,028,474, and not a conventional honeycomb, is used as a plasma-guiding layer. Folded honeycombs of this type are formed by folding a flat, closed material layer on defined fold lines.

Figure 4:
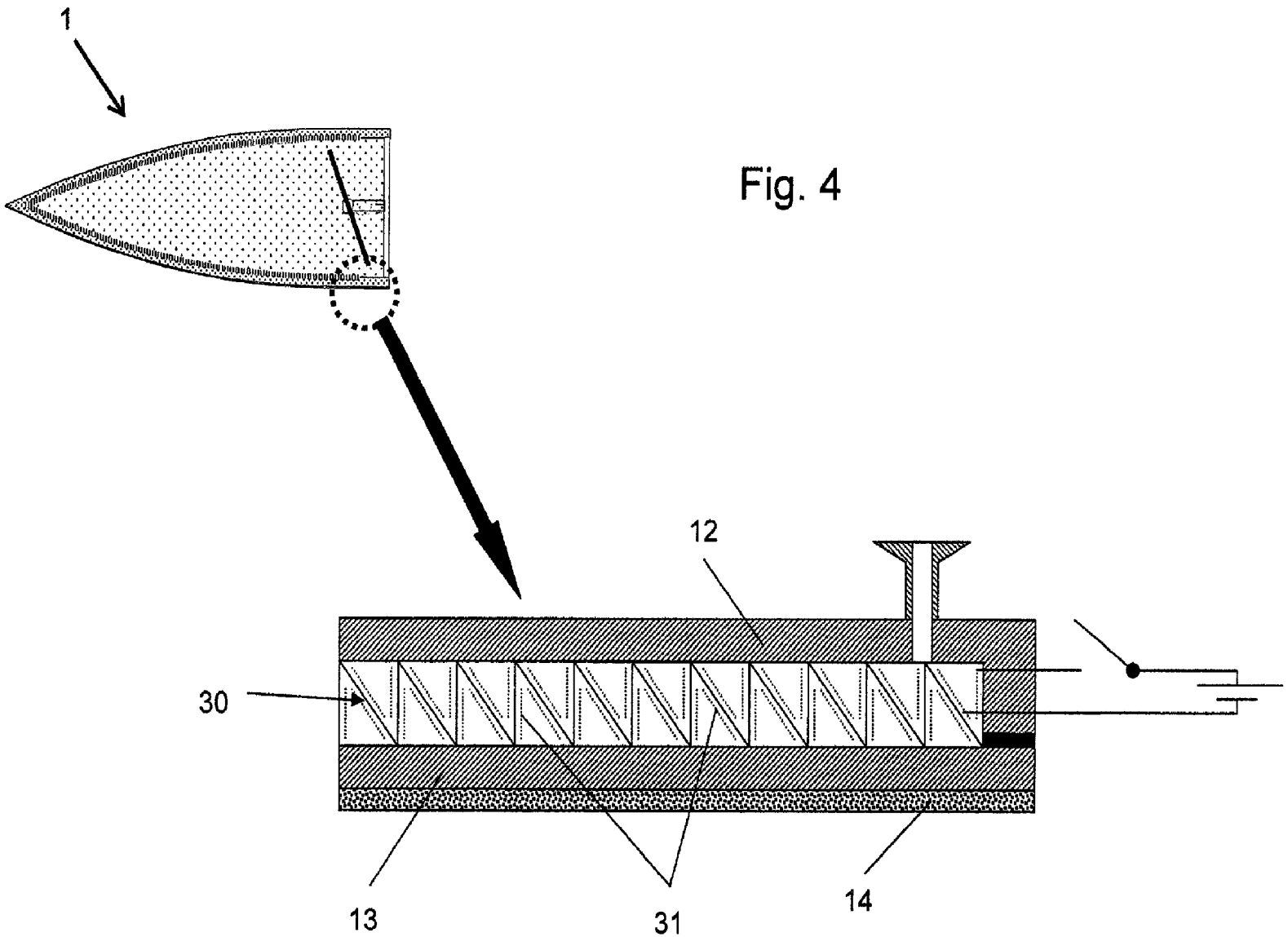
FIG. 4 illustrates a structure of a radome according to another embodiment of the invention with folded honeycomb as a core.

As shown in FIG. 4, instead of the normal honeycomb, folded honeycomb 30 is integrated into the radome structure with the two cover layers 12 and 13 and optional protective layers 14. In this case, it is even particularly advantageous to apply electrodes 31 of frequency-selective layers directly onto the surface of folded honeycomb 30. In this case, to achieve a certain band-pass characteristic of radome 1, additional frequency-selective layers can be integrated into or onto the radome structure.

Folded honeycombs are characterized in that the honeycomb structures can form continuous airways so that the folded honeycomb can be ventilated. In this way, the perforation necessary with conventional honeycombs can be omitted. Moreover, folded honeycombs by definition can be rolled, so that the electrodes of frequency-selective layers can be applied directly onto both sides of the honeycomb material before the folding of the honeycomb.

Figure 5:
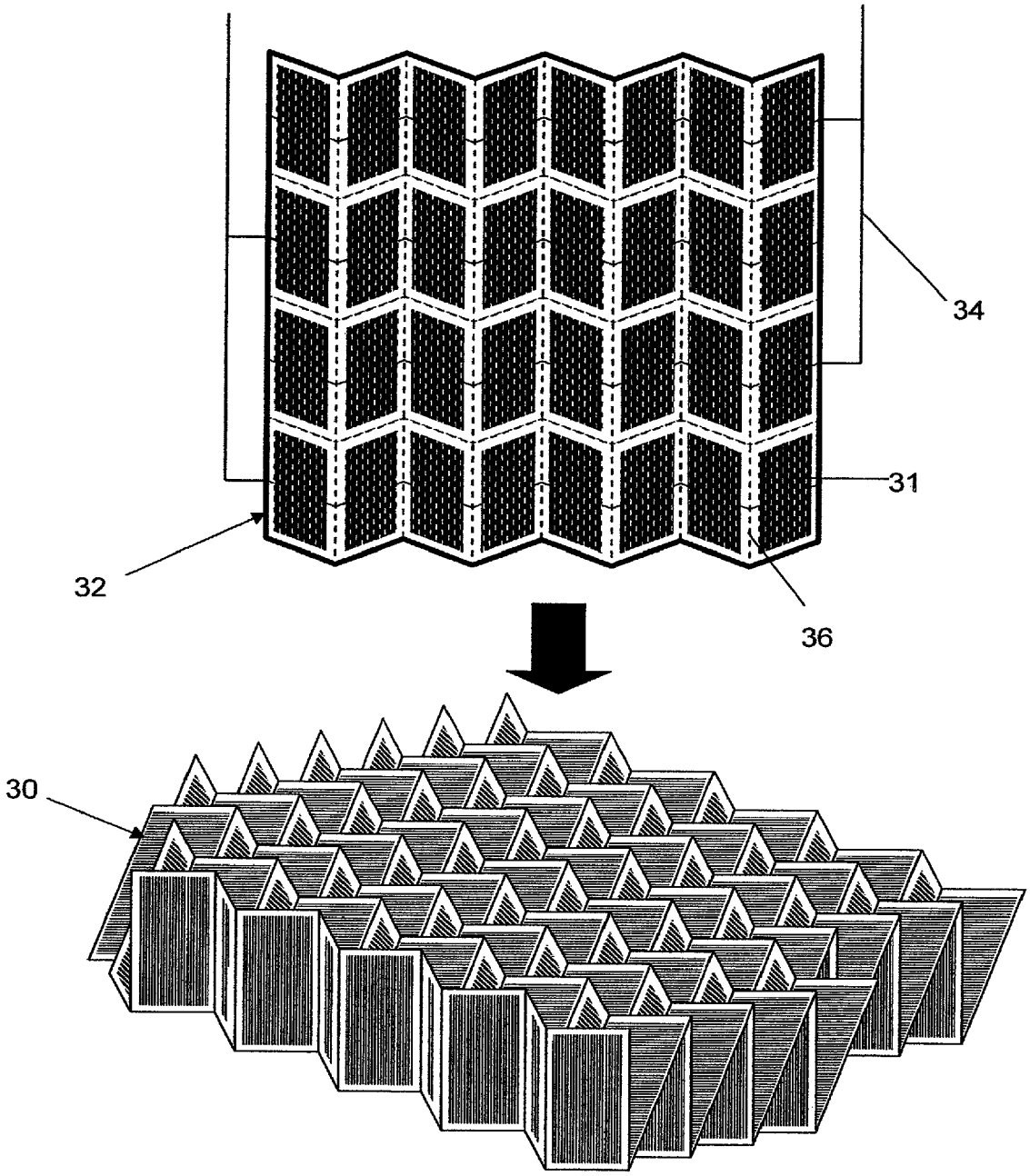
FIG. 5 diagrammatically illustrates the folded honeycomb core depicted in FIG. 4.

As shown in FIG. 5, electrodes 31 of frequency-selective layers are attached, e.g., pressed, on flat honeycomb starting material 32 on both sides between the later fold lines 36. Rows of electrodes with the same polarity are thereby connected in parallel by short conductor paths 34, so that the rows connected in parallel can be jointly contacted from the side. The same polarity should be applied respectively thereby with opposite electrodes on both sides of the honeycomb material in order to avoid an electrical breakdown through the honeycomb material.

After premarking of the fold lines, the flat honeycomb material thus pretreated is then pushed together to form folded honeycomb 30.

Figure 6:
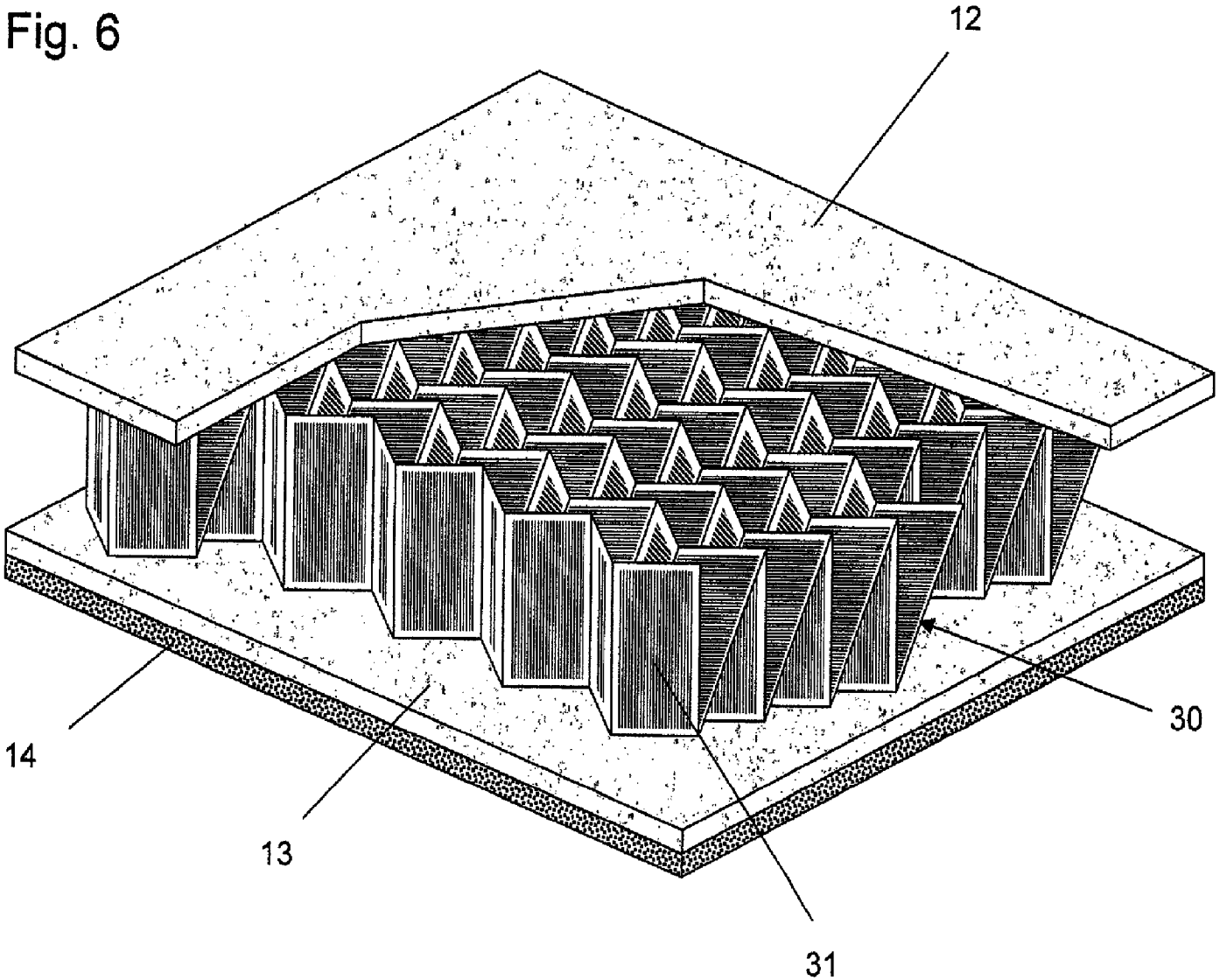
FIG. 6 illustrates a three-dimensional representation of the radome with the folded honeycomb core according to FIG. 4.

FIG. 6 shows the structure of radome 1 according to the invention according to FIGS. 4 and 5 in three-dimensional representation.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A radome with an integrated plasma shutter covering an antenna, comprising: a honeycomb core comprising a plasma-guiding layer, and with a gas mixture suitable for the generation of a plasma therein; coverplates arranged to sandwich the honeycomb core; and electrodes structured and arranged for plasma excitation, the electrodes being high frequency (HF)—transparent at least in an operating frequency range of the antenna.

2. The radome in accordance with claim 1, wherein the electrodes comprise frequency-selective layers formed as band-pass filters in the operating frequency range of the antenna.

3. The radome in accordance with claim 1, wherein the electrodes are arranged on the cover plates.

4. The radome in accordance with claim 1, wherein the electrodes are arranged on walls of the honeycomb core.

5. The radome in accordance with claim 1, wherein the honeycomb core comprises a folded honeycomb.

6. The radome in accordance with claim 1, wherein the walls of the honeycomb core have perforations.

7. The radome in accordance with claim 1, wherein the plasma-guiding layer is switchable between a plasma state and a recombined state.

8. The radome in accordance with claim 7, wherein in the plasma state, the plasma-guiding layer is conductive, and in the recombined state, the plasma-guiding layer is electromagnetically transparent.

9. The radome in accordance with claim 1, wherein the electrodes comprise continuous metal layers with structured slots.

10. The radome in accordance with claim 9, wherein the slots are formed as bandpass filters.

11. A method for selectively shielding an antenna, comprising:

introducing a gas mixture suitable for the generation of a plasma into a plasma-guiding layer comprising a honeycomb core sandwiched by two coverplates of a radome covering antenna;

applying a voltage to the gas mixture suitable for generation of a plasma to ignite the plasma in the plasma-guiding layer;

selectively switching the plasma-guiding layer to produce a conductive plasma state or a non-conductive recombined state, wherein, the plasma-guiding layer is arranged to between the antenna and a target, and when the plasma-guiding layer is switched into the recombined state, a signal from the antenna passes through the plasma-guiding layer to the target.

12. The method in accordance with claim 11, further comprising generating a plasma with lamellar frequency-selective electrodes.

13. The method in accordance with claim 12, wherein the plasma-guiding layer is sandwiched between the electrodes.

14. The method in accordance with claim 11, wherein the honeycomb core comprises a folded honeycomb with perforated walls.

15. A radome covering an antenna, comprising: a plasma shutter comprising a plasma-guiding layer with a gas mixture suitable for the generation of a plasma therein and electrodes for exciting a plasma; and coverplates arranged to sandwich the plasma-guiding layer, wherein the electrodes are selectively operable to open the plasma shutter so as to be transparent to electromagnetic radiation at least in an operating frequency range of the antenna.

16. The radome in accordance with claim 15, wherein the electrodes comprise frequency-selective layers formed as band-pass filters in the operating frequency range of the antenna.

17. The radome in accordance with claim 15, wherein the electrodes are arranged on opposite sides of the plasma-guiding layer.

18. The radome in accordance with claim 15, wherein the plasma-guiding layer comprises a honeycomb core.

19. The radome in accordance with claim 18, wherein the electrodes are arranged on walls of the honeycomb core.

* * * * *